US010994296B2

(12) United States Patent
Baek

(10) Patent No.: US 10,994,296 B2
(45) Date of Patent: May 4, 2021

(54) HOLDING DEVICE FOR SPRAY CONTAINER

(71) Applicant: Jung Youl Baek, Los Angeles, CA (US)

(72) Inventor: Jung Youl Baek, Los Angeles, CA (US)

( * ) Notice: Subject to any disclaimer, the term of this patent is extended or adjusted under 35 U.S.C. 154(b) by 0 days.

(21) Appl. No.: 16/501,467

(22) Filed: Mar. 11, 2019

(65) Prior Publication Data

US 2020/0290074 A1 Sep. 17, 2020

(51) Int. Cl.
*B05B 12/00* (2018.01)
*B05B 11/00* (2006.01)
*B05B 9/08* (2006.01)

(52) U.S. Cl.
CPC ..... *B05B 12/0024* (2018.08); *B05B 11/0005* (2013.01); *B05B 9/0883* (2013.01)

(58) Field of Classification Search
CPC ..... B05B 12/0024; B05B 11/0005; B05B 9/0883
USPC ..... 222/402.14
See application file for complete search history.

(56) References Cited

U.S. PATENT DOCUMENTS 3,178,077 A * 4/1965 Benedetto ..... B65D 83/24 222/402.13
2002/0020722 A1* 2/2002 Uemura ..... B65D 83/24 222/402.13
2008/0308583 A1* 12/2008 Matsuyama ..... B65D 83/24 222/402.14

* cited by examiner

*Primary Examiner* — Donnell A Long
(74) *Attorney, Agent, or Firm* — Heedong Chae; Lucem, PC

(57) ABSTRACT

A holding device is used to maintaining a push button of a spray container to be pressed to release contents without continuous press by an operator. The holding device for a spray container comprises a supporting part which is placed around the push button, an adjusting part having a pillar-shaped portion standing on the supporting part and a diving board-shaped portion connected to the pillar-shaped portion and extending over a top of the push button, on a top of the diving board-shaped portion having a recess; and an auxiliary part being pillar-shaped and standing on the supporting part, having a protrusion toward the adjusting part to be engaged with the recess.

17 Claims, 7 Drawing Sheets

HOLDING DEVICE FOR SPRAY CONTAINER

FIELD OF THE INVENTION

The present invention pertains generally to the field of dispensing, and more particularly to a securing device for a fluid dispenser to maintain the dispenser in an open or closed state.

BACKGROUND OF THE INVENTION

A sprayer containing fluid under pressure releases the fluid by pressing a push button equipped with the sprayer. This spray-type container is used in various fields such as painting as it enables an operator to apply large volumes of fluid rapidly with substantial control over the fineness and density of the spray mist. In addition, this spray-type container can store the rest of the contents in a good condition for great lengths of time.

However, it is difficult for an operator to maintain a continuous or constant pressure by his finger on the push button for any great length of time due to fatigue. It may lead to failures of control over the fineness. Further, other securing devices only disclose big, heavy, or complicated structures; those structures lead to significant operator fatigue or cause high manufacturing costs.

SUMMARY OF THE INVENTION

The present invention provides a holding device for a spray container that makes the spray container maintain a continuous release without a constant force of an operator. The present invention is downsized and light, which prevents an operator from suffering fatigue and occupies minimal space. Furthermore, the present invention is functioning with the simplicity of a standard spray container and reusable. Also, the present invention has a simple structure, which offers reduced cost of manufacture.

Embodiments of the inventive concept provide a holding device for a spray container including a body and a push button on a top of the body, said holding device comprising a supporting part which is placed around the push button; an adjusting part having a pillar-shaped portion standing on the supporting part, and a diving board-shaped portion connected to the pillar-shaped portion and extending over a top of the push button, on a top of the diving board-shaped portion having a recess; and an auxiliary part being pillar-shaped and standing on the supporting part, having a protrusion toward the adjusting part to be engaged with the recess.

Other embodiments of the inventive concept provide a holding device for a spray container including a body, a push button on a top of the body, and a coupling ring connecting between the body and the push button, said holding device comprising a supporting part being loop-shaped, which is placed on a top of the body and within the perimeter of the top of the body around the push button; an adjusting part having pillar-shaped portion standing on the supporting part, and a diving board-shaped portion connected to the pillar-shaped portion and extending over a top of the push button, having a first interlocking part; and an auxiliary part being pillar-shaped and standing on the supporting part, having a second interlocking part to be engaged with the first interlocking part, wherein a width of the holding device is equal to or lesser than that of the body in a direction perpendicular to the push button pressed.

Other embodiments of the inventive concept provide a holding device for a spray container including a body, a push button on a top of the body, and a coupling ring connecting between the body and the push button, said device comprising supporting part being loop-shaped, which is placed on a top of the body around the push button, having at least one inward protrusion on the bottom to be engaged with a groove formed between the body and the coupling ring; an adjusting part having a pillar-shaped portion standing on the supporting part, and a diving board-shaped portion connected to the pillar-shaped portion and extending over a top of the push button, having a first interlocking part; and an auxiliary part being pillar-shaped and standing on the supporting part, having a second interlocking part to be engaged with the first interlocking part.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTIONS

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as form "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
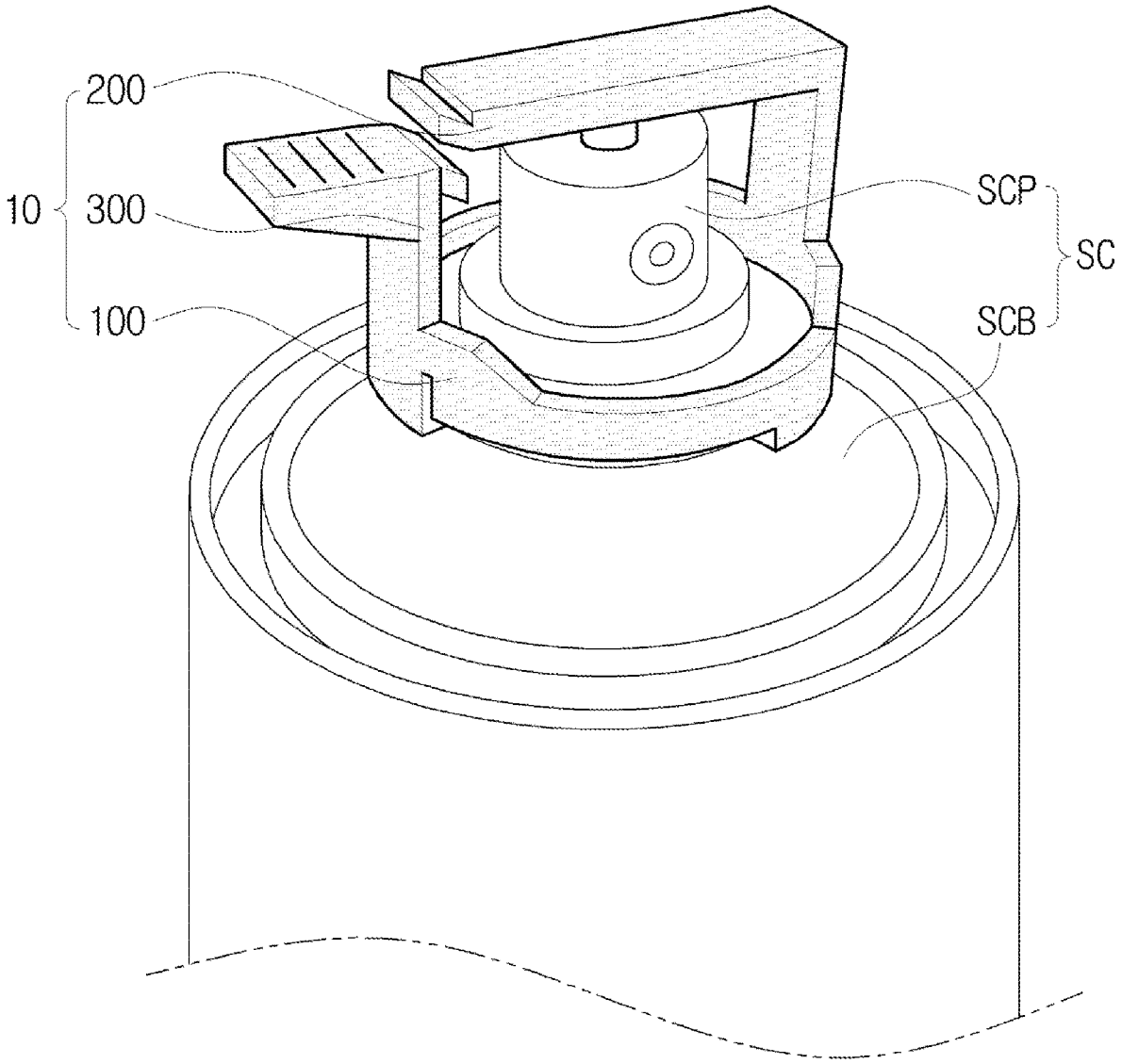
FIG. 1 shows a perspective view of a holding device mounted on a spray container according to one embodiment of the present invention.

FIG. 1 show a perspective view of a holding device 10 mounted on a spray container SC according to one embodiment of the present invention.

According to FIG. 1, a holding device 10 is mounted on a top of body SCB of a spray container SC around a push button SCP.

The spray container SC may contain fluid in a body SCB under pressure and release the fluid by pressing a push button SCP equipped with the body SCB. The spray container SC may be a paint sprayer containing paint but not limited to. The spray container SC may be any commercial standard spray containers.

The holding device 10 comprises a supporting part 100, an adjusting part 200, and an auxiliary part 300. The supporting part 100, an adjusting part 200, and an auxiliary part 300 may be connected to each other indivisibly in one body. Further, The supporting part 100, an adjusting part 200, and an auxiliary part 300 may be made of the same material such as plastic but not limited to. According to the present invention, the holding device 10 may have a simple structure and one material, which can offer reduced cost of manufacture.

Figure 2:
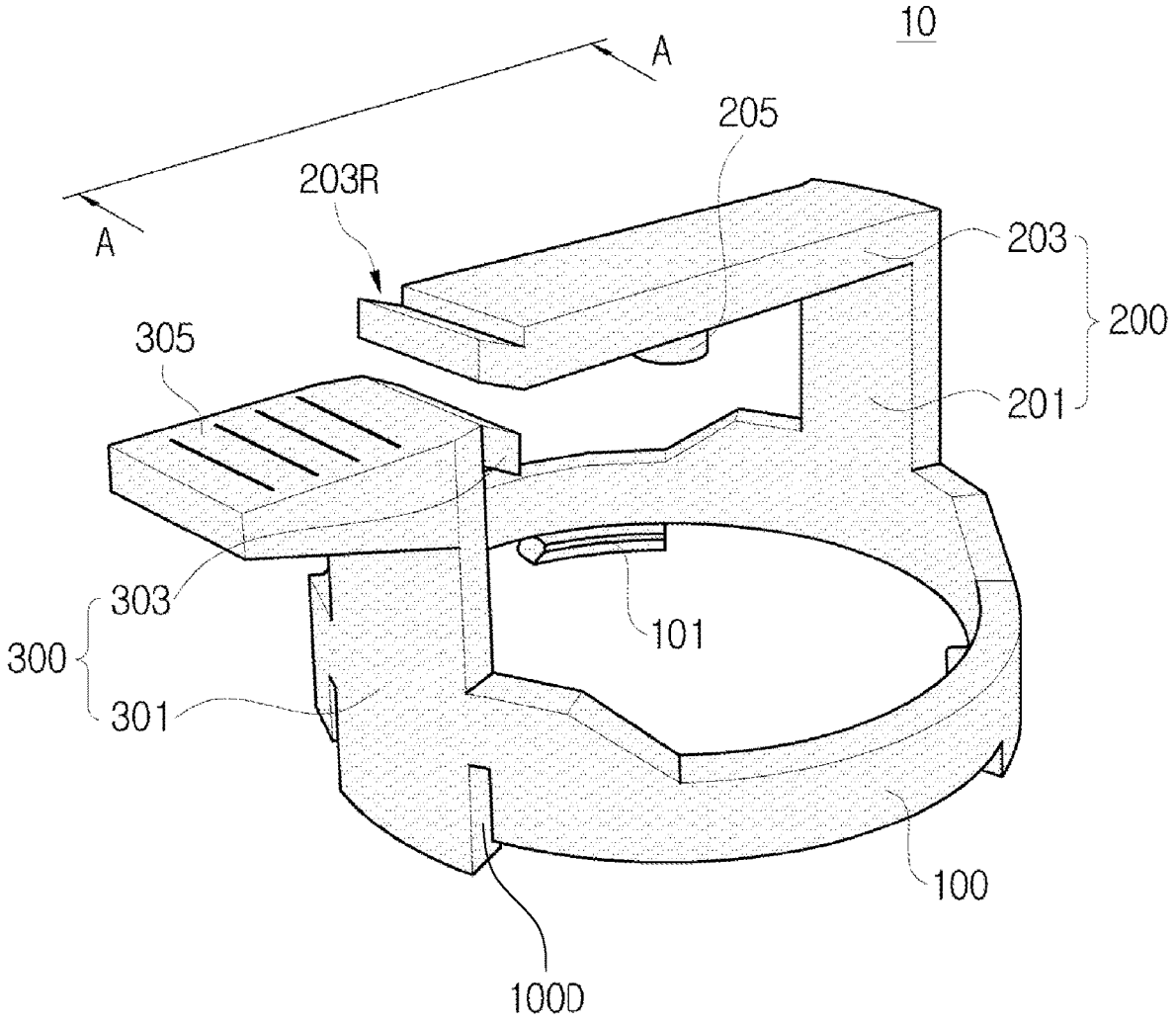
FIG. 2 shows a perspective view from above of the holding device of FIG. 1.
Figure 3:
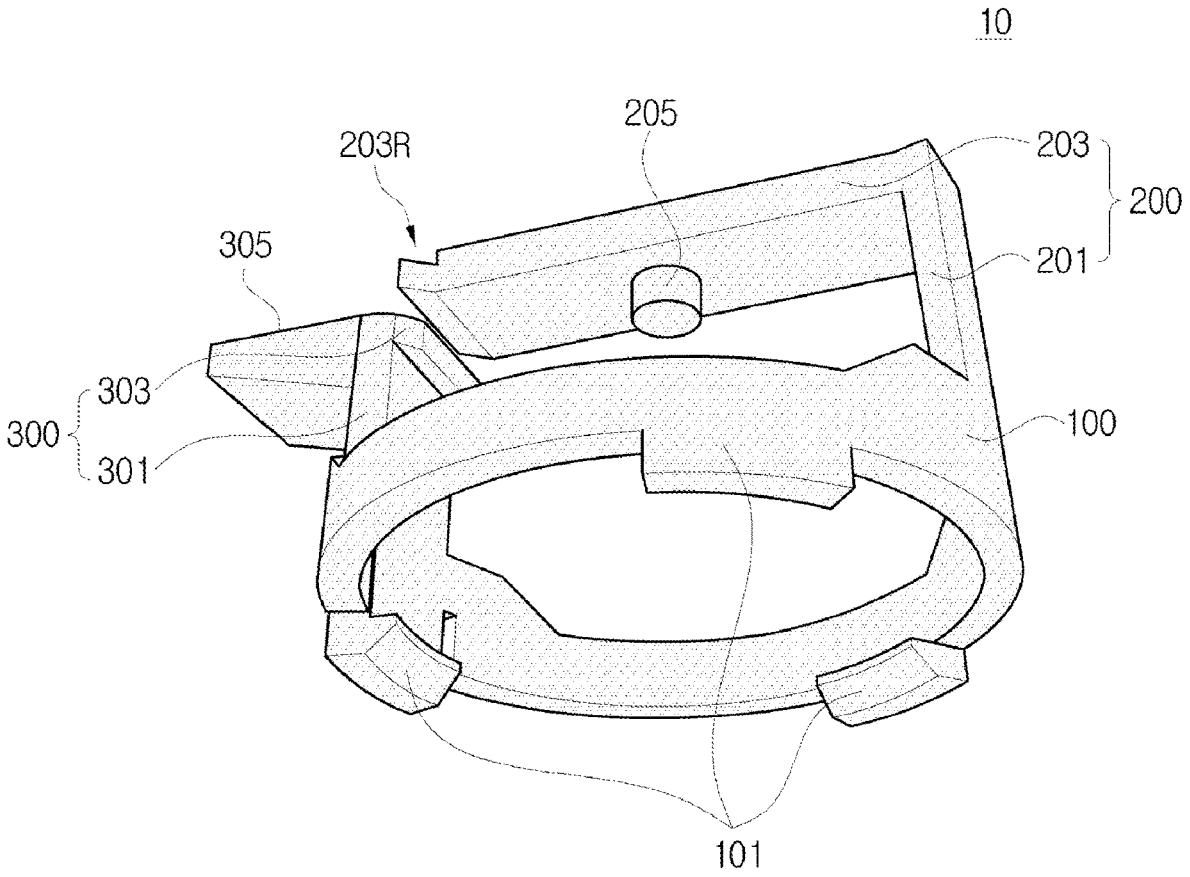
FIG. 3 shows a perspective view from bottom of the holding device of FIG. 1.

FIG. 2 shows a perspective view from above of the holding device 10 of FIG. 1 that is detached and apart from the top of the body SCB of the spray container SC. FIG. 3 shows a perspective view from bottom of the holding device of FIG. 1 that is detached and apart from the top of the body SCB of the spray container SC.

According to FIGS. 1, 2 and 3, the supporting part 100 may be loop-shaped and placed on a top of the body SCB of the spray container SC around the push button SCP. A top of the supporting part 100 may be lower than a top of the push button SCP. The supporting part 100 may be within the perimeter of the top of the body SCB. The supporting part 100 may comprise at least one inward protrusion 101, a fixing part, on the bottom. The inward protrusion 101 is constructed to engage with or disengage from a substantially annular groove SCG formed between the body SCB and the coupling ring SCC in the FIGS. 4 and 5 and fixed to the spray container SC. As shown in FIGS. 2 and 3, the inward protrusion 101 is lies below a bottom boundary of the supporting part, the bottom boundary of the support part being oriented towards the body SCB of the spray container SC when the holding device 10 is detachably coupled to the spray container SC. The supporting part 100 may include cuts 100D on the bottom in both sides of the inward protrusion 101. The cuts 100D on both sides of the inward protrusions 101 may allow the inward protrusions 101 to be opened, which makes it easier for the holding device 10 to engage with and disengage from the groove SCG of the spray container SC.

The adjusting part 200 has a pillar-shaped portion 201 standing on a top of the supporting part 100 and a diving board-shaped portion 203 connected to a top of the pillar-shaped portion 201. The diving board-shaped portion 203 may extend over a top of the push button SCP to contact with the push button SCP when the diving board-shaped portion 203 of the adjusting part 200 is pressed downward. The diving board-shaped portion 203 may include a recess 203R, a first interlocking part, on the top. The recess 203R may be formed an end of the diving board-shaped portion 203 but not limited to. The diving board-shaped portion 203 may include a contact area 205 on the bottom. The contact area 205 may be protruded toward the push button SCP. The contact area 205 contacts with the push button SCP when the diving board-shaped portion 203 is pressed downward.

The auxiliary part 300 may include a pillar-shaped portion 301 that is connected to the supporting part 100. The auxiliary part 300 may have an interlocking protrusion 303, a second interlocking part, extending toward the adjusting part 200. The interlocking protrusion 303 is to be engaged with the recess 203R when the diving board-shaped portion 203 is pressed downward to the extent that the recess 203R is located under the interlocking protrusion 303. The auxiliary part 300 may include an adjustment arm 305 protruded toward an outside of the supporting part 100. In other words, the adjustment arm 305 may protrude in an opposite direction to that of the interlocking protrusion 303, wherein the interlocking protrusion 303 is directed substantially inwardly towards a center of the holding device 10 as shown in FIG. 2.

As shown in FIG. 2, a first end of the pillar-shaped portion 301 is joined to the adjustment arm 305. A second end of the pillar-shaped portion 301 of the auxiliary part 300 is joined to one of the inward protrusion 101; the second end of the pillar-shaped portion 301 of the auxiliary part 300 lies opposite to the first end of the pillar-shaped portion 301 of the auxiliary part 300. Furthermore, the first and second ends of the pillar-shaped portion 301 are substantially similar in width. As shown, the cuts 100D about either sides of the inward protrusion 101 also help form part of the outer edges and the shape of the second end of the pillar-shaped portion 301. This construction of the pillar-shaped portion 301 together with the inward protrusion 101 allows the second end of the pillar-shaped portion 301 and the inward protrusion 101 to move in response to the movement of the first end of the pillar-shaped portion 301. Also shown in FIG. 2, the adjustment arm 305 is constructed and configured to be contiguous with at least one of the inward protrusions 101 such that movement of the adjustment arm 305 towards a center of the holding device 10 causes the inward protrusion 101 that is joined to the second end of the pillar-shaped portion 301 to move away from the center of the holding device 10; this movement allows the holding device 10 to engage to or disengage from the spray container SC. When the adjustment arm 305 is moved away from center, the inward protrusion 101 moves towards the center; this movement may result in the inward protrusion 101 engaging with the spray container SC if the holding device 10 is placed thereabouts.

In the embodiment in FIGS. 1, 2, and 3, the recess 203R and the interlocking protrusion 303 function as a first interlocking part and a second interlocking part respectively; however, the first interlocking part in the adjusting part 200 and the second interlocking part in the auxiliary part may have various structure to be engaged with each other.

Figure 4:
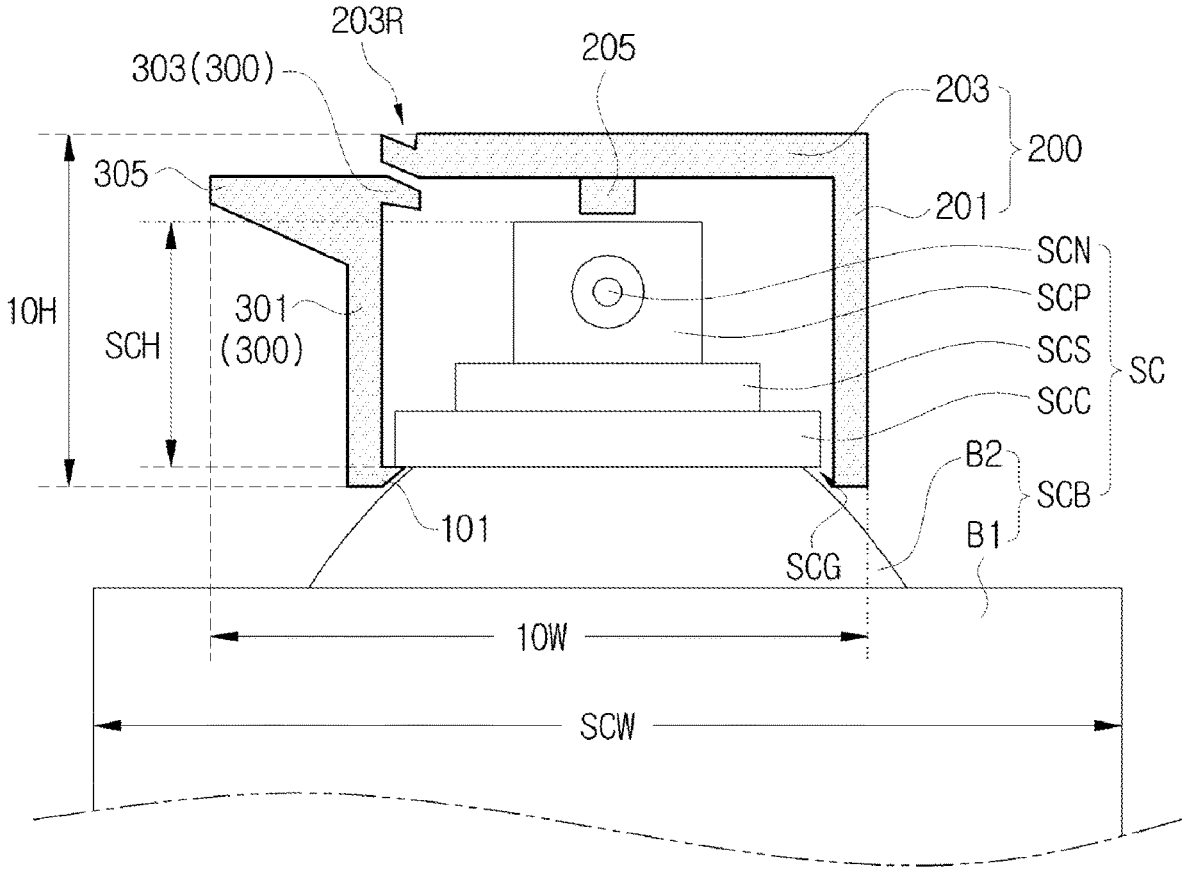
FIG. 4 shows a cross-sectional view of the holding device along line A-A of the FIG. 1.
Figure 5:
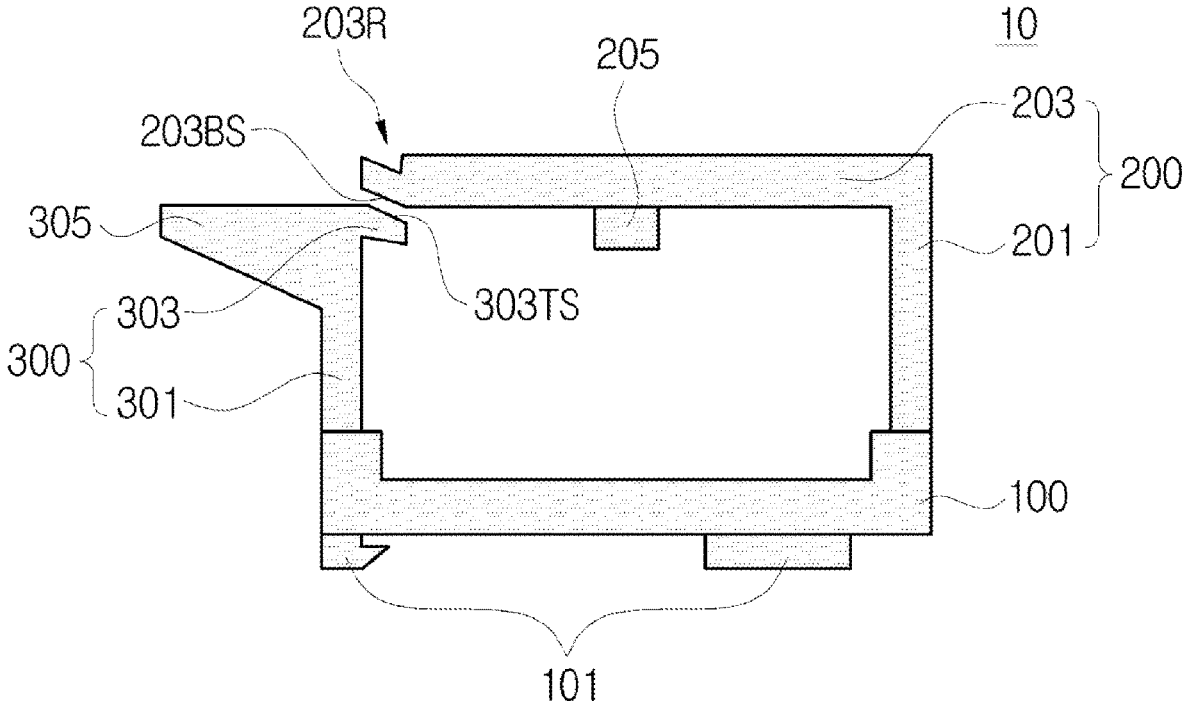
FIG. 5 shows a side view of the holding device of FIG. 2.
Figure 6:
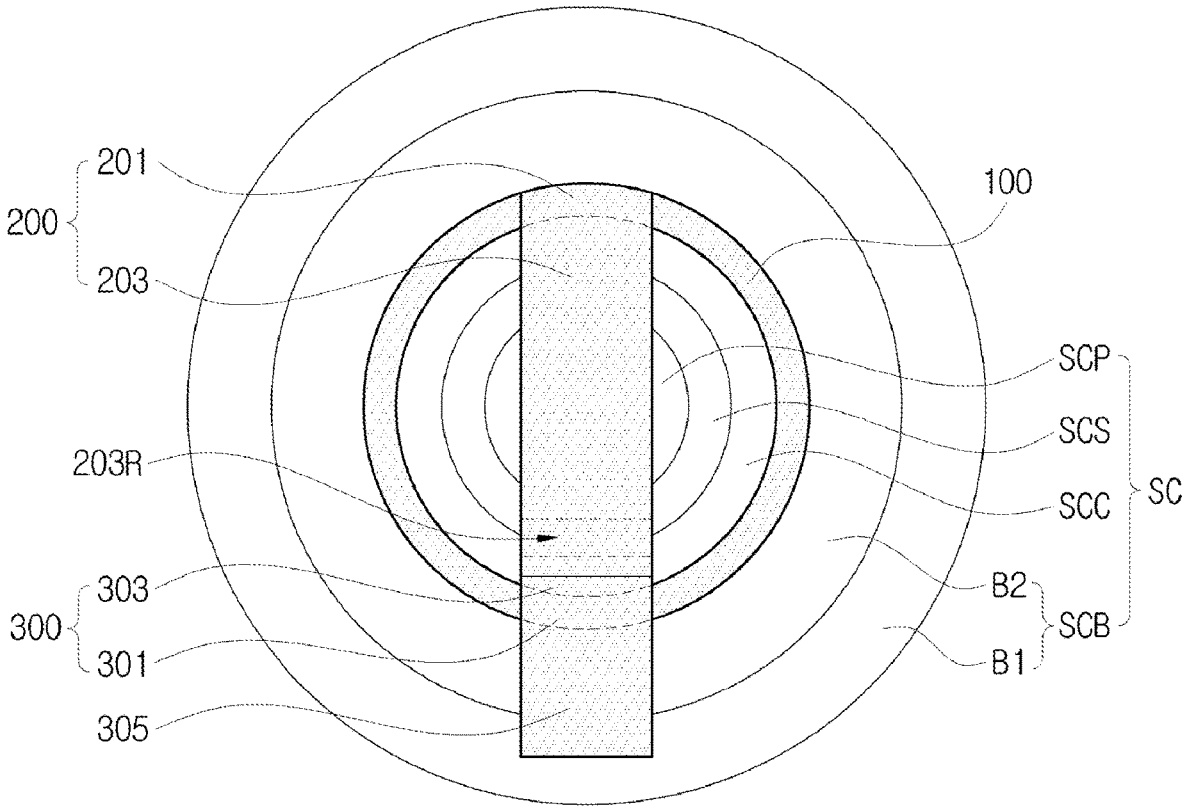
FIG. 6 shows a plan view of the holding device of FIG. 1.

FIG. 4 show a cross-sectional view of the holding device 10 along line A-A of the FIG. 2. FIG. 5 show a side view of the holding device 10 of FIGS. 2 and 3. FIG. 6 show a plan view of the holding device 10 of FIG. 1.

According to FIGS. 4, 5, and 6, the holding device 10 is mounted on the spray container SC. The spray container SC may be one of commercial standard spray containers; The spray container SC may include a body SCB, a coupling ring SCC, a sealing ring SCS, and a push button SCP. The body SCB may comprise a first part B1 containing substance and a second part B2 for being connected to the coupling ring SCC. The second part B2 may be tapered to the top or dorm-shaped. The coupling ring SCC may connect between the second part B2 and the push button SCP. The sealing ring SCS may be located between the coupling ring SCC and the push button SCP. A groove SCG is formed along the circumference between the second body B2 and the coupling ring SCC.

The inward protrusions 101 on the bottom of the supporting part 100 are protruded toward inside of the supporting part 100. The inward protrusion 101 can engage with or disengage from the groove SCG, which makes the holding device 10 fixed to the spray container SC when the inward protrusion 101 is detachably coupled with the groove SCG. In the embodiment in FIGS. 1, 2, and 3, the inward protrusion 101 functions as a fixing part, which makes the holding device 10 fixed to the spray container SC; however, the fixing part in other embodiments may have other structure other than the inward protrusion 101. In these alternative embodiments, the fixing part may be adhesive on the bottom of the supporting part 100 to make the holding device 10 is fixed to the spray container SC.

The supporting part 100 may be within the perimeter of the top of the body SCB. In addition, a width 10W of the holding device 10 may be equal to or lesser than that of the body SCW in a direction perpendicular to the push button pressed, in other words, in a X direction. Further, a height 10H of the holding device 10 may be lessor than twice a height SCH of a stack of the push button SCP, the sealing ring SCS, and the coupling ring SCC. According to the present invention, the holding device 10 is significantly downsized and light, which prevents an operator from suffering fatigue and it also occupies minimal space.

The recess 203R formed on a top of the diving board-shaped portion 203 may be located in an end of the diving board-shaped portion 203 but not limited to.

A bottom side 203BS of an end of the diving board-shaped portion 203 and a top side 303TS of the interlocking protrusion 303 may be sloped. Sloped shapes of the bottom side 203BS and the top side 303TS make it easier for an operator to press the diving board-shaped portion 203 and make engagement between the recess 203R and the protrusion 303.

Figure 7:
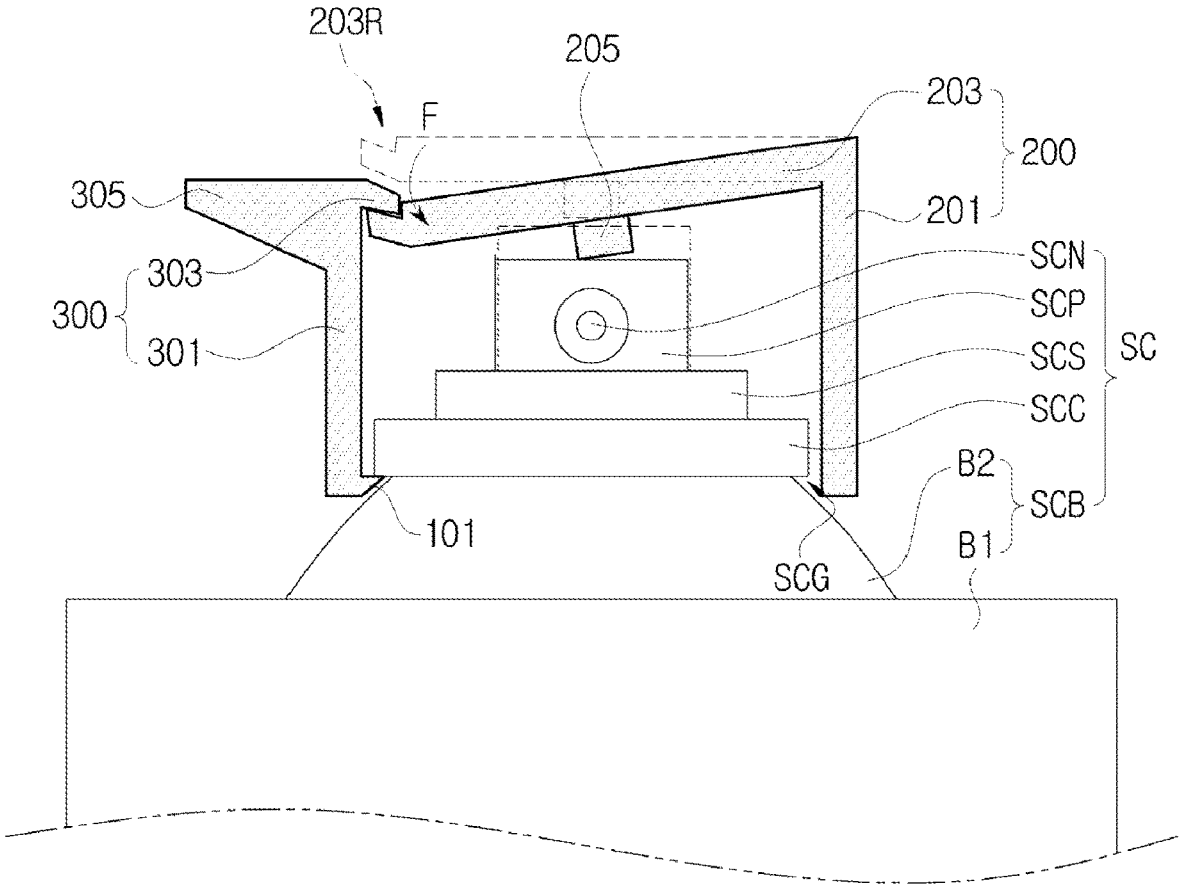
FIG. 7 shows a cross-sectional view of the holding device along line A-A of the FIG. 1 and a first position and a second position of the holding device.

FIG. 7 show a cross-sectional view of the holding device 10 along line A-A of the FIG. 1 and a first position and a second position of the holding device. The first position is described in dotted lines, and the second position is described in solid lines.

According to FIG. 7, the adjusting part 200 may have a first position which is an open state and a second position which is a closed state.

In the first position, the holding device 10 is just mounted and fixed to the spray container SC, and the diving board-shaped portion 203 and/or the contact area 205 do not press the push button SCP. The recess 203R of the diving board-shaped portion 203 is located higher than the interlocking protrusion 303 of the auxiliary part 300 in a parallel direction of the push button pressed, in other words, in a Y direction. In the first position, the recess 203R and the interlocking protrusion 303 are not engaged with each other, and the spray container SC does not release the substance.

The second position may be made by a single click F on the diving board-shaped portion 203. Once an operator presses the diving board-shaped portion 203 downward until the recess 203R is engaged with the interlocking protrusion 303, the second position is maintained. The adjusting part 200 may be made of plastic but not limited to.

In the second position, the recess 203R is located lower than the interlocking protrusion 303 in a Y direction. As the bottom of the diving board-shaped portion 203 or/and the contact area 205 press the push button SCP, the spray container keeps releasing the substance through nozzle SCN during the second position. Accordingly, the holding device 10 makes the spray container SC maintain a continuous release without a constant force of an operator. It can prevent significant operator fatigue.

While the invention has been shown and described with reference to different embodiments thereof, it will be appreciated by those skilled in the art that variations in form, detail, compositions and operation my be made without departing from the spirit and scope of the invention as defined by the accompanying claims.

What is claimed is:

1. A holding device for a spray container which includes a body, a push button on a top of the body, a coupling ring, and a groove formed between the body and the coupling ring, the holding device comprising:

a supporting part which is placed around the push button, the supporting part including a plurality of inward protrusions;

an adjusting part including:

a pillar-shaped portion standing on the supporting part; and a diving board-shaped portion connected to the pillar-shaped portion and extending over a top of the push button, on a top of the diving board-shaped portion having a first interlocking part; and an auxiliary part including:

a pillar-shaped portion connected to the supporting part;

an adjustment arm which protrudes toward an outside of the supporting part; and a second interlocking part to be engaged with the first interlocking part, wherein the inward protrusions project towards a center of the holding device, wherein the adjustment arm is joined to a first end of the pillar-shaped portion of the auxiliary part and at least one of the inward protrusions is joined to a second end of the pillar-shaped portion of the auxiliary part, wherein the inward protrusions are constructed to detachably couple with the spray container, wherein the inward protrusions are interspaced from each other, wherein cuts are formed on both sides of the pillar-shaped portion of the auxiliary part upwardly from both sides of the one of the inward protrusions, and wherein movement of the adjustment arm towards a center of the holding device causes the inward protrusion to move away from the center of the holding device and permit the holding device to disengage from the spray container.

2. The device of claim 1, wherein the adjusting part further includes:

a first position in which the first interlocking part and the second interlocking part are not engaged, and a second position in which the first interlocking part and the second interlocking part are engaged with each other.

3. The device of claim 2, wherein, in the first position, the first interlocking part is located higher than the second interlocking part in a parallel direction of the push button pressed, and wherein, in the second position, the first interlocking part is located lower than the second interlocking part.

4. The device of claim 2, wherein, in the first position, the adjusting part does not press the push button, and wherein, in the second position, the adjusting part presses the push button.

5. The device of claim 1, wherein the supporting part is loop-shaped within the perimeter of the top of the body, wherein a width of the holding device is equal to or less than that of the body in a direction perpendicular to the push button pressed.

6. The device of claim 1, wherein a height of the holding device is lessee than twice that of the push button and the coupling ring.

7. The device of claim 1, wherein the inward protrusion is constructed to engage with, and disengage from, the groove.

8. The device of claim 1, wherein the supporting part, the adjusting part, and the auxiliary part are made of the same material.

9. The device of claim 1, wherein the device is made of one material.

10. The device of claim 1, wherein the first interlocking part is placed in an end of the diving board-shaped portion.

11. The device of claim 1, wherein an end of a bottom of the diving board-shaped portion and a top of the second interlocking part are sloped.

12. The device of claim 1, wherein a bottom of the diving board-shaped portion has a contact area which is to contact with the push button, wherein the contact area is protruded toward the push button.

13. The device of claim 1, wherein a top of the supporting part is lower than a top of the push button.

14. A holding device for a spray container including a body, a push button on a top of the body, a coupling ring, and a groove formed between the body and the coupling ring, said holding device comprising:

a supporting part being loop-shaped, which is placed on a top of the body and within the perimeter of the top of the body around the push button;

an adjusting part including:

a pillar-shaped portion standing on the supporting part; and a diving board-shaped portion connected to the pillar-shaped portion and extending over a top of the push button, having a first interlocking part; and an auxiliary part including:

a pillar-shaped portion connected to the supporting part; and a second interlocking part to be engaged with the first interlocking part, wherein the supporting part includes:

a plurality of inward protrusions; and cuts formed on both sides of the pillar-shaped portion of the auxiliary part upwardly from both sides of the one of the inward protrusions, wherein at least one of the inward protrusions is joined to an end of the pillar-shaped portion of the auxiliary part, wherein the inward protrusions project towards a center of the holding device, wherein the inward protrusions are constructed to detachably couple with the groove, wherein the inward protrusions are interspaced from each other, and wherein a width of the holding device is equal to or less than that of the body in a direction perpendicular to the push button pressed.

15. The device of claim 14, wherein a height of the holding device is less than twice that of the push button and the coupling ring.

16. A holding device for a spray container including a body, a push button on a top of the body, a coupling ring, and a groove formed between the body and the coupling ring, said device comprising:

a supporting part being loop-shaped, which is placed on a top of the body around the push button, having at least one inward protrusion on the bottom to be engaged with the groove;

an adjusting part having:

a pillar-shaped portion standing on the supporting part, and a diving board-shaped portion connected to the pillar-shaped portion and extending over a top of the push button, having a first interlocking part;

an auxiliary part including a pillar-shaped portion connected to the supporting part; and a second interlocking part to be engaged with the first interlocking part, wherein the supporting part includes a plurality of inward protrusions, wherein the inward protrusions project towards a center of the holding device, wherein the inward protrusions are constructed to detachably couple with the groove, wherein the inward protrusions are interspaced from each other, wherein a first end of the pillar-shaped portion lies above the supporting part, wherein a second end of the pillar-shaped portion of the auxiliary part lies below an area where the pillar-shaped portion of the auxiliary part and the supporting part meet, and wherein at least one of the inward protrusions is joined to the second end of the pillar-shaped portion of the auxiliary part.

17. The device of claim 16, wherein the first interlocking part is a recess, and the second interlocking part is a interlocking protrusion toward the adjusting part;

wherein the supporting part is loop-shaped within the perimeter of the top of the body, wherein a width of the holding device is equal to or less than that of the body in a direction perpendicular to the push button pressed; and wherein a height of the holding device is less than twice that of the push button and the coupling ring.

* * * * *